US006176466B1

(12) United States Patent
Lam et al.

(10) Patent No.: US 6,176,466 B1
(45) Date of Patent: Jan. 23, 2001

(54) COMPOSITE PUMPING TREE WITH INTEGRAL SHUT-OFF VALVE

(75) Inventors: Tony M. Lam; Keith D. Farquharson, both of Edmonton (CA)

(73) Assignee: Steam-Flo Industries, Ltd., Edmonton (CA)

( * ) Notice: Under 35 U.S.C. 154(b), the term of this patent shall be extended for 0 days.

(21) Appl. No.: 09/379,978

(22) Filed: Aug. 24, 1999

(51) Int. Cl.[7] ..... E21B 33/06

(52) U.S. Cl. ..... 251/1.3; 251/1.1; 166/85.4; 166/86.1; 166/97.1; 137/613

(58) Field of Search ..... 137/613; 166/85.4, 166/97.1, 85.1, 75.13, 86.1; 251/1.1, 1.2, 1.3

(56) References Cited

U.S. PATENT DOCUMENTS

| | | | | |
|---|---|---|---|---|
| 2,638,169 | * | 5/1953 | Crain | 166/85.4 |
| 5,743,332 | * | 4/1998 | Lam et al. | 166/85.4 |
| 5,875,841 | * | 3/1999 | Wright et al. | 251/1.3 X |
| 5,878,812 | * | 3/1999 | Heinonen et al. | 166/85.4 |
| 6,024,172 | * | 2/2000 | Lee | 166/85.4 X |

* cited by examiner

*Primary Examiner*—Kevin Lee
(74) *Attorney, Agent, or Firm*—Sheridan Ross P.C.

(57) ABSTRACT

A unitary pumping tree is provided for forming part of a wellhead assembly christmas tree. The tree integrates a bottom connector, shut-off valve, hydraulically actuated blow-out preventer, mechanically actuated blow-out preventer, flow tee and top connector, within a body formed as a single piece of steel.

7 Claims, 8 Drawing Sheets

28
27
25
20
23
18
15
19
10
12
4
1
2
5
8

COMPOSITE PUMPING TREE WITH INTEGRAL SHUT-OFF VALVE

FIELD OF THE INVENTION

The present invention relates to a composite pumping tree for use in a production wellhead assembly. The tree is formed using a unitary steel body. The body has appropriate side openings for integrating a shut-off valve, blow-out preventer and flow tee with bottom and top connectors, to form the tree. The bottom connector is adapted to connect with a tubing head and the top connector is adapted to connect with an upper segment of a production christmas tree, of which the composite tree forms a lower part.

BACKGROUND OF THE INVENTION

The present invention has to do with wellhead equipment used in connection with pumping oil wells. More particularly, as previously stated, it relates to a composite pumping tree. By "composite" is meant that the functional components referred to herein as top and bottom connectors, shut-off valve, production blow-out preventer and flow tee are integrated into a single steel body. The term "pumping tree" is used to generically encompass the body or housing, its component openings, its axial fluid flow bore and the functional components if they are mounted in the body openings.

For many years, a typical conventional production wellhead assembly for a pumping well was as shown in FIG. 1 and comprised, from the bottom up: a flanged casing bowl attached to the well casing; a flanged tubing head having an internal hanger from which the well tubing string was suspended; a tubing head adapter having a flanged connection at its bottom end and a threaded connection of smaller diameter at its top end; a production blow-out preventer ("B.O.P.") body having top and bottom threaded connections and including side openings for receiving the B.O.P. ram components; a flow tee body having a threaded or flanged side opening for connecting with a flow line; and additional components (not shown), such as a polish rod stuffing box and the rotary drive assembly for rotating the well's rod string to power a downhole progressive cavity pump. (The overall assembly extending up from the top of the tubing head to the drive assembly is commonly referred to as the production christmas tree.)

The production christmas tree, as described in the previous paragraph, is designed for use in connection with a pumping well. Since the tree is subjected only to relatively low pressure in service, its parts are relatively thin-walled.

There are some pumping wells which, when shut in, can build up significant pressure at the wellhead due to the presence of gas in the produced fluid. When the rod string is pulled from the well, to service the downhole pump, it would be desirable to have a gate valve in place between the tubing head and the production tree, to provide a positive and reliable shut-off.

In the case of a naturally flowing well, where greater pressures would be expected, one or more high pressure shut-off valves are stacked between the tubing head and the flow tee and the production B.O.P. is usually not included.

A recent improvement in the production wellhead art is disclosed in Canadian Patent 2,197,584, issued Jul. 7, 1998 to the present applicant. More particularly this patent teaches integrating the tubing head adapter, B.O.P. and flow tee into a unitary structure or tree by forging or casting a single steel body or structure forming an axial vertical fluid flow bore and further comprising, from the bottom up:

- a bottom connector or connection sized and designed to connect and seal with the top connection of the tubing head;
- a B.O.P. housing section forming side openings connecting with the axial bore, for receiving the ram components of a B.O.P.;
- a flow tee housing section forming a side opening and providing means for connecting with a flow line; and
- a top connector sized and designed to connect with the upper section of the christmas tree (typically with the stuffing box).

In a preferred form, the generally tubular '584 tree has a generally cylindrical outer configuration, thereby ensuring a relatively thick body side wall of consistent thickness.

The '584 tree has been characterized by certain advantages, more particularly:

- the unitary tree is significantly shorter and stronger as a result of removing the threaded or flanged connections between the functional components. This is particularly useful in the case where a vibrating offset rotary drive assembly is mounted on the top end of the christmas tree for rotating the rod string of a downhole progressive cavity pump; and
- the thick side wall of the cylindrical body is amenable to drilling additional openings from the side, for example for insertion of an instrumentation string to measure bottom hole temperature or pressure. This feature permits the tree to be customized to meet the particular needs of a customer.

SUMMARY OF THE INVENTION

In accordance with the invention, the tree body of the '584 patent has been lengthened and formed to provide an additional side opening, beneath the B.O.P. openings, for receiving a shut-off valve. Thus a shut-off valve and a production B.O.P. are combined in a pumping tree to provide a shut off capability whether the rod string is parted at the polish rod or not.

While a typical 2⁹⁄₁₆ inch shut-off gate valve having flanged connections might have a length in the order of 16.6 inches, we find that the same valve components, when mounted into the tree body opening, will add only about 6 inches to the body length. The resulting composite pumping tree is still short enough and strong enough to permit a rod string rotary drive assembly to be mounted and operated thereon satisfactorily.

In a preferred embodiment, the blow-out preventer used immediately above the shut-off valve is hydraulically operated. This has led to a problem because the B.O.P. operator (which protrudes externally of the body) and shut-off valve hand wheel can interfere if stacked directly above each other. This difficulty has been resolved by staggering or relatively off-setting them about the perimeter of the body.

As a final preferred addition, the tree body can be formed to provide a second pair of opposed B.O.P. component openings above the first pair and beneath the flow tee opening. The ram components of a manually operated B.O.P. are mounted into these openings. The resulting composite pumping tree is still sufficiently short and strong enough to permit a rod string rotary drive assembly to be mounted and operated thereon satisfactorily.

DESCRIPTION OF THE DRAWINGS

FIG. 5*a* is a plan view taken along the line A—A of FIG. 5, showing the integral hydraulic line of the hydraulic B.O.P.;

DESCRIPTION OF THE PREFERRED EMBODIMENT

Figure 1:
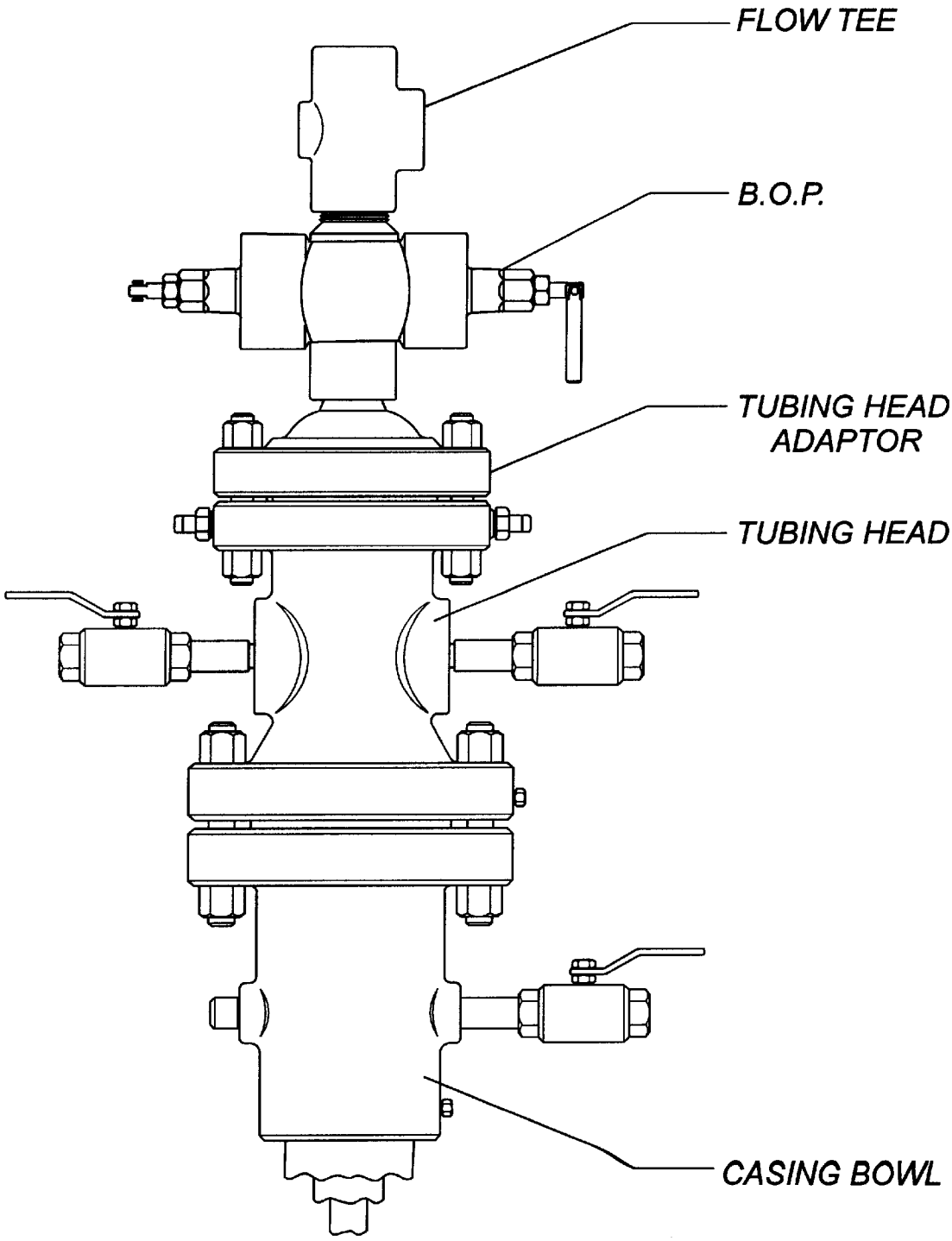
FIG. 1 (Prior Art)
FIG. 1 is a side view of a wellhead for a pumping well comprising a conventional pumping tree formed of interconnected separate functional components.
Figure 2:
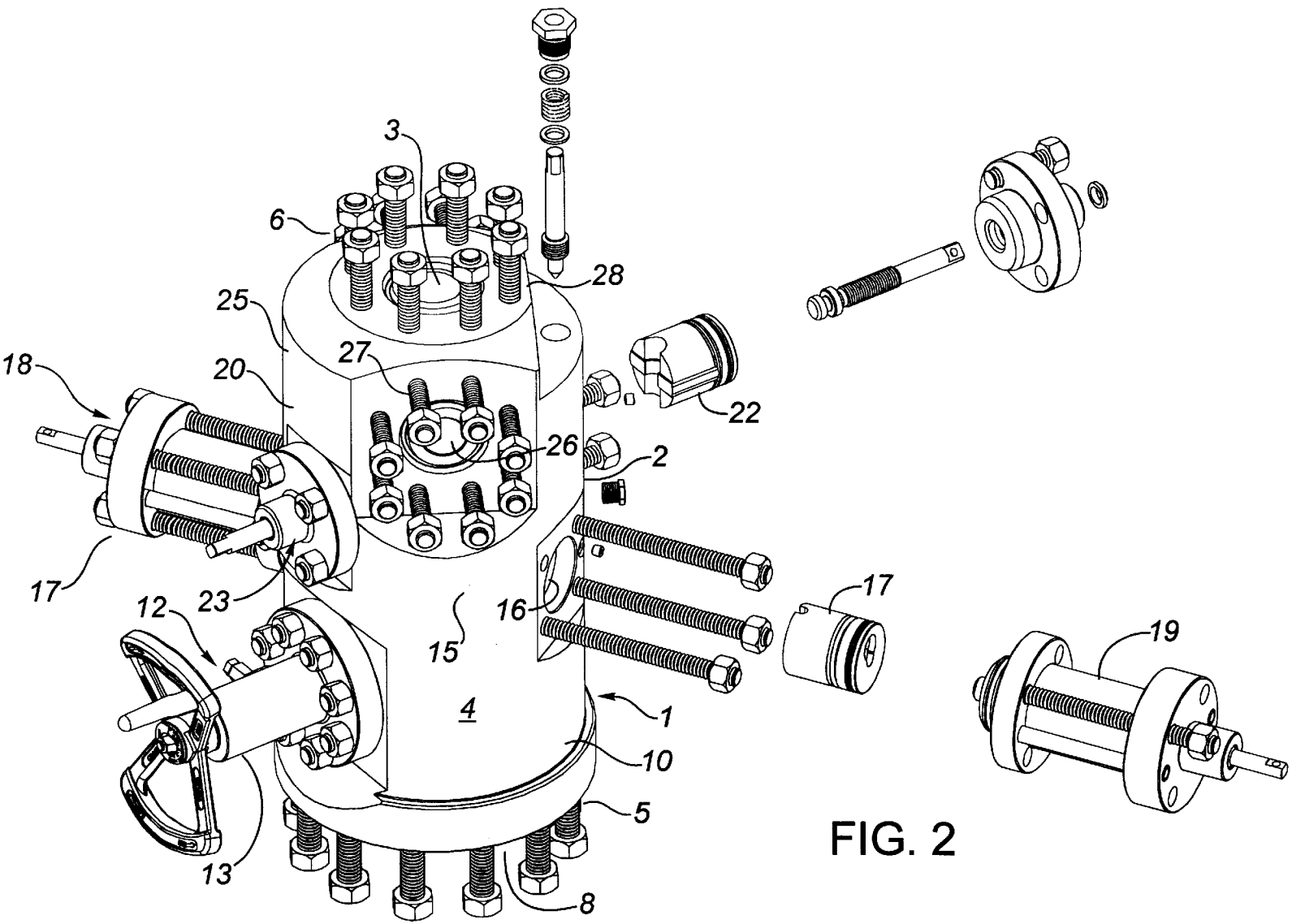
FIG. 2 is a perspective view of a pumping tree in accordance with the present invention, with some of the component parts exploded to show their detail. The tree comprises a bottom connector for connection with a tubing head, a shut-off valve, a hydraulic production B.O.P., a manual production B.O.P., a flow tee and a top connector for connection with a stuffing box (not shown)
Figure 3:
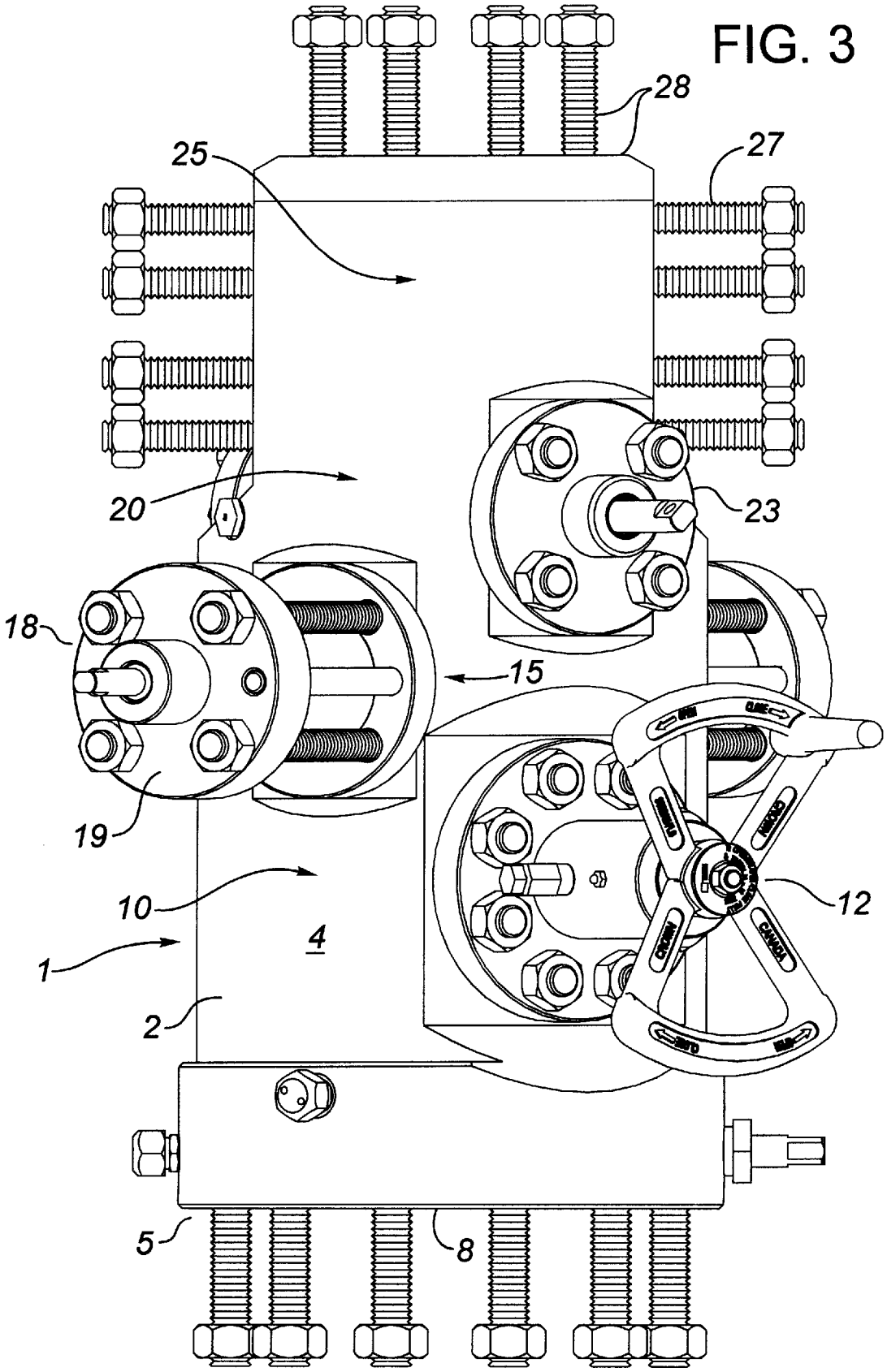
FIG. 3 is a side view of the assembled tree of FIG. 2.
Figure 4:
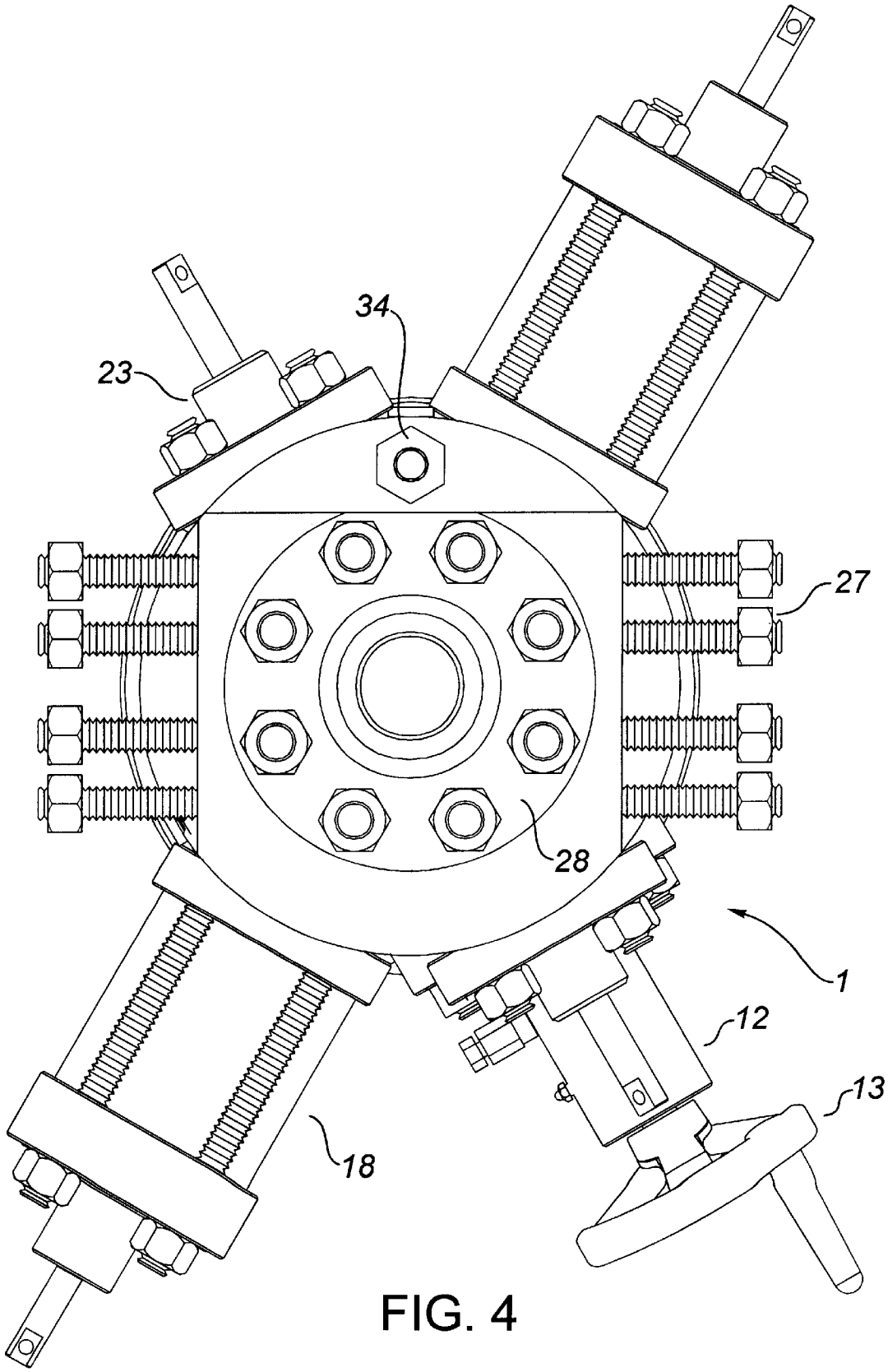
FIG. 4 is a top plan view of the tree of FIG. 2.
Figure 5:
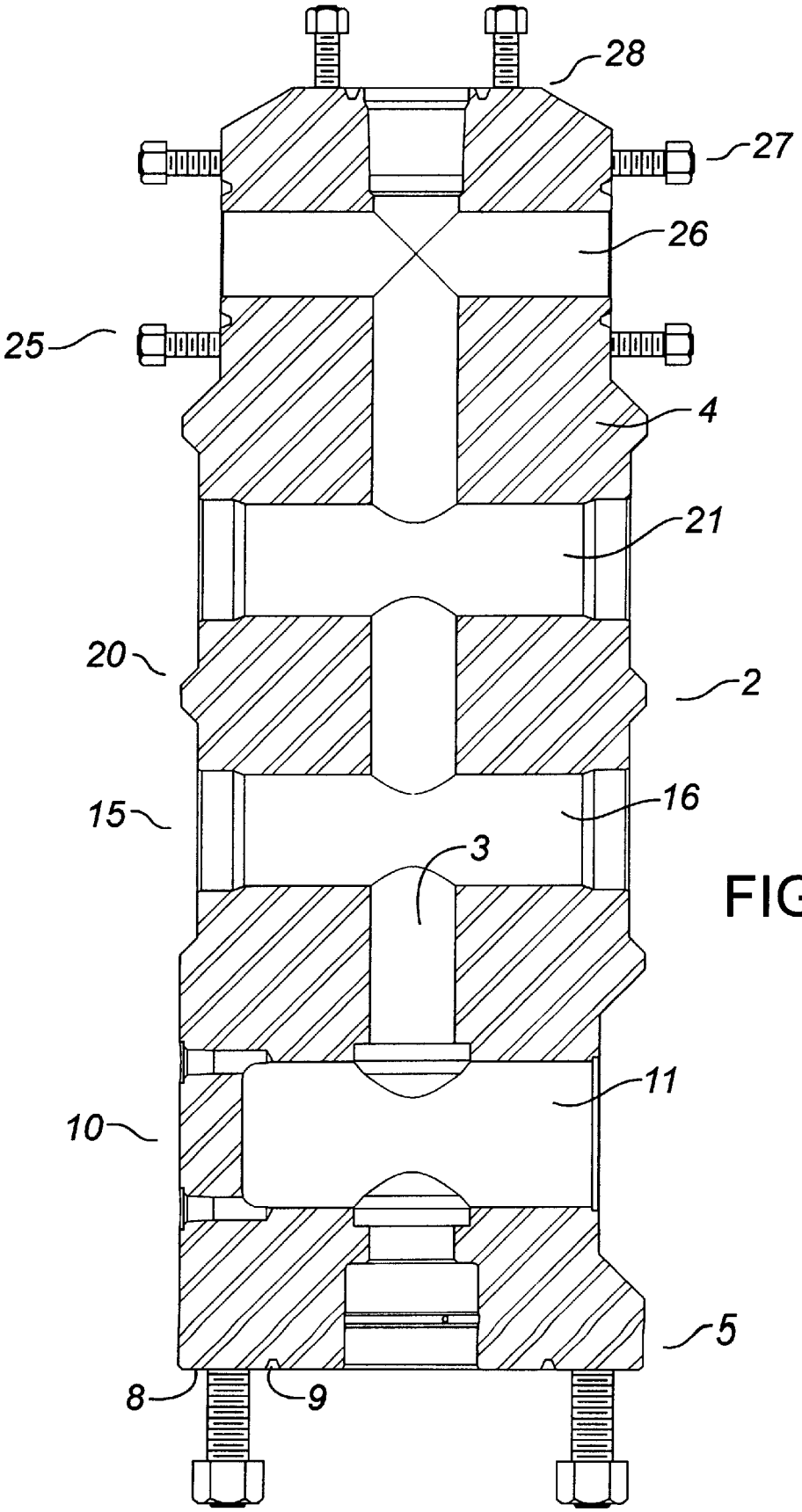
FIG. 5 is a side sectional view showing the body of the tree of FIG. 2 with the functional components removed, with all bores/openings shown on same orientation for simplicity.
Figure 6:
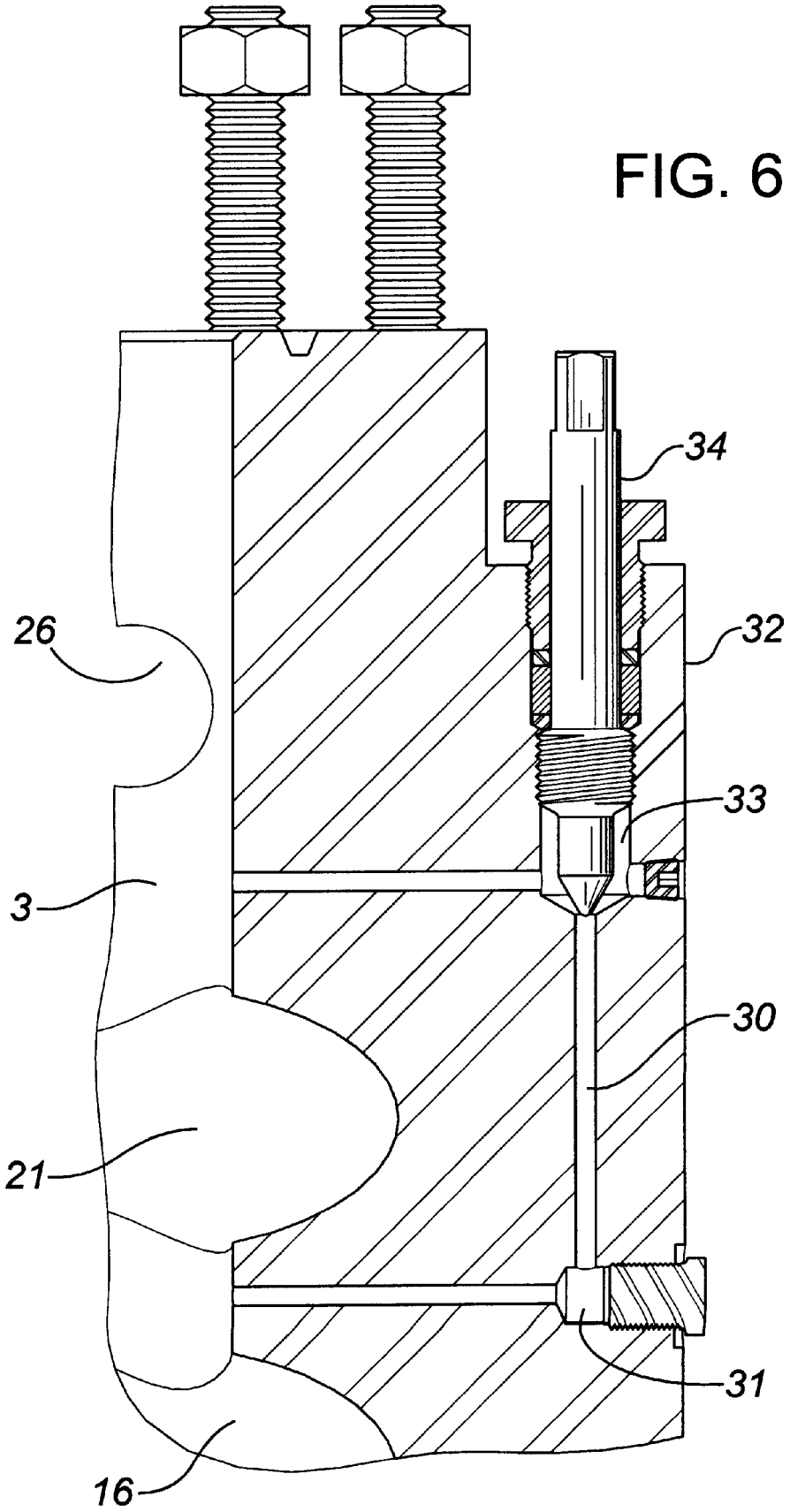
FIG. 6 is a side sectional view showing a bleeder valve and passageway for monitoring pressure between the hydraulic and manual B.O.P.'s.
Figure 7:
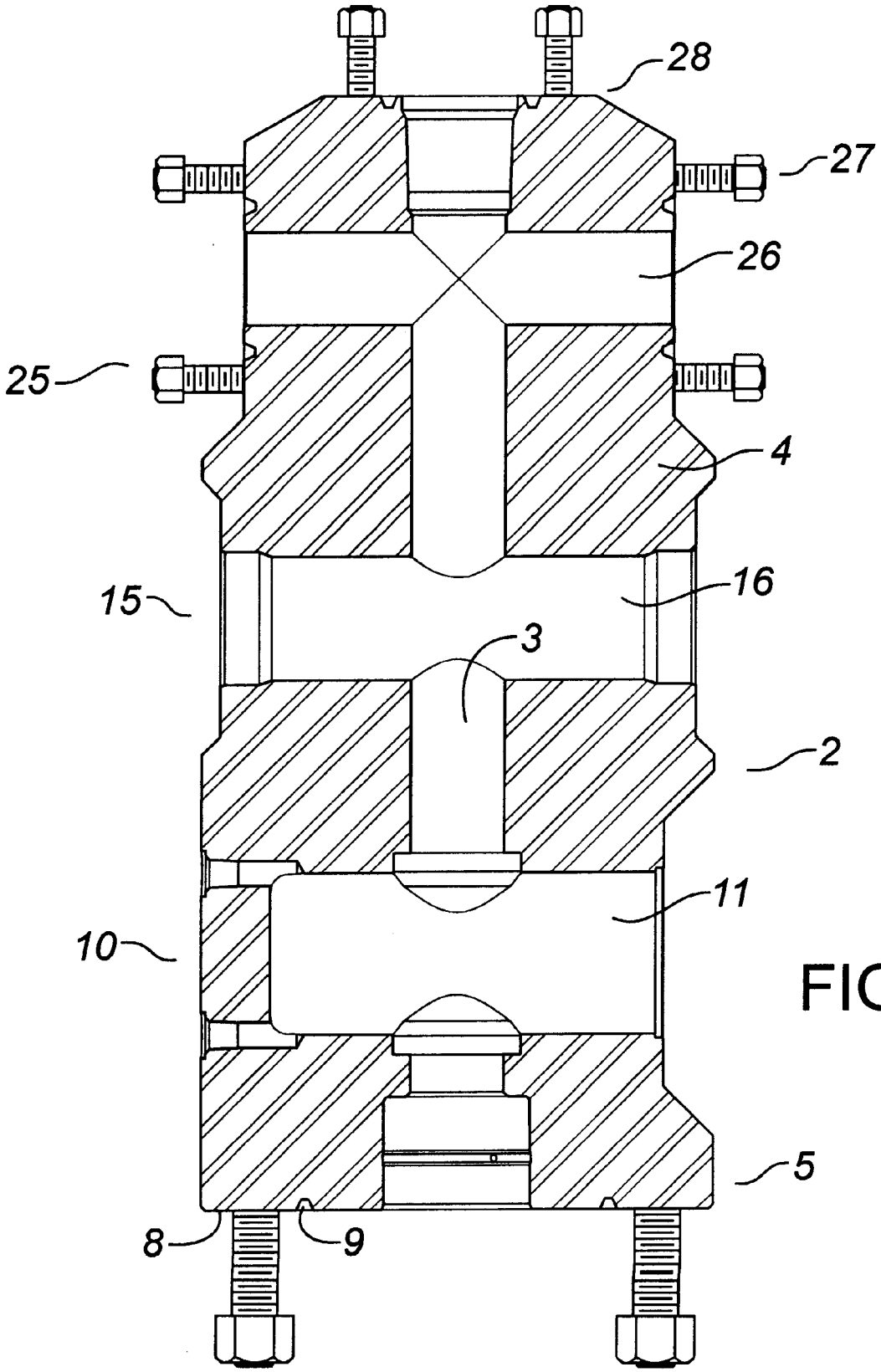
FIG. 7 is a side sectional view showing the body of a tree employing only a single B.O.P.
Figure 8:
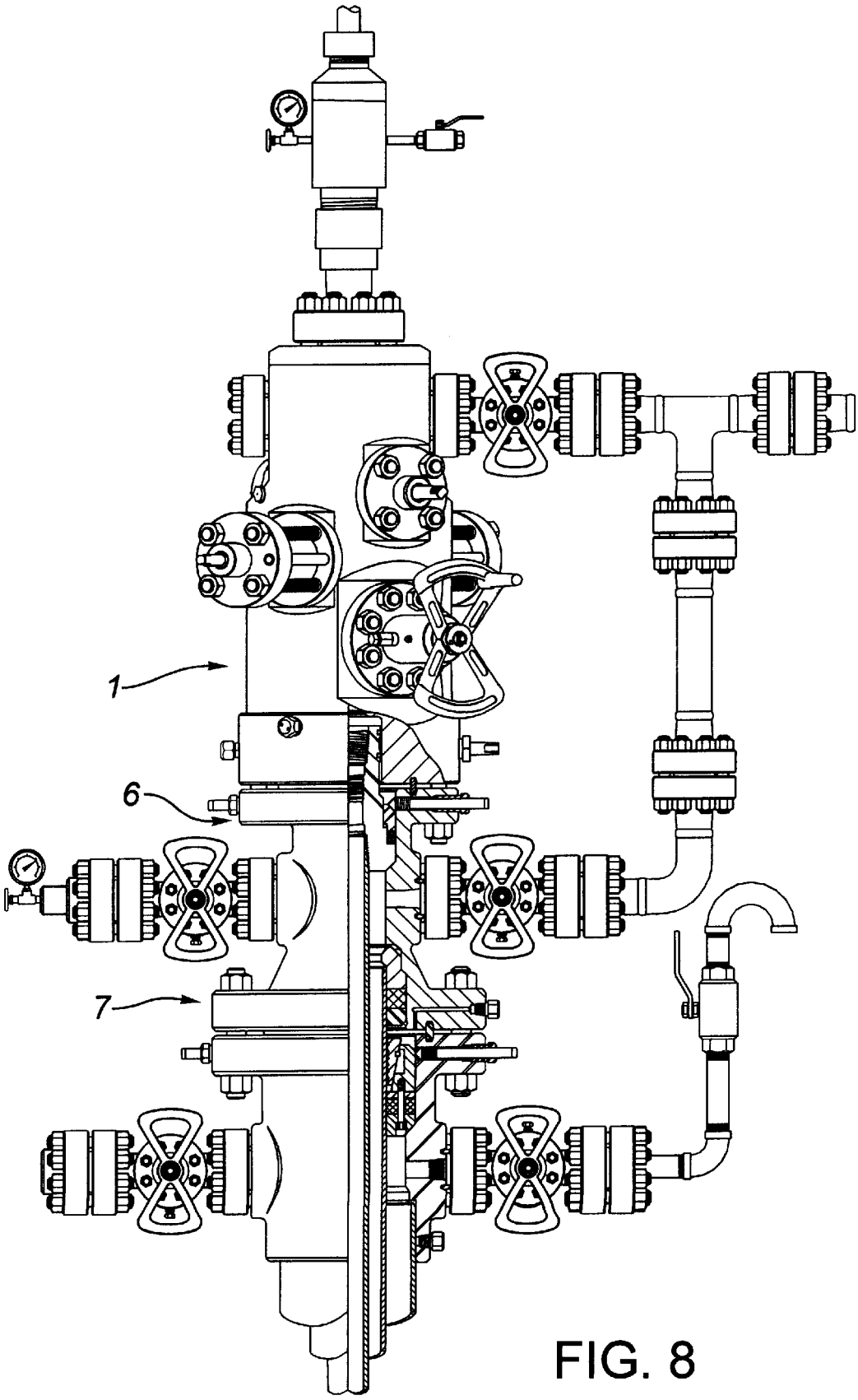
FIG. 8 is a side view showing the tree of FIG. 2 incorporated into a wellhead assembly.

The pumping tree 1 comprises an integral body 2 formed as a single piece of steel. It is generally tubular, having an axial, vertical fluid flow bore 3 extending therethrough. It is also generally cylindrical externally to provide a body side wall 4 of generally consistent thickness, having a wall thickness/bore diameter ratio in the range of 1 to 1 or greater.

The body 2 has a bottom connector 5 for connection with the flanged top connection 6 of a tubing head 7. The bottom connector 5 is shown as a studded down connection. However it can be a flanged connection, clamp-hub connection or rotatable flange connection as well. The face 8 of the connector 5 forms a seal ring groove 9 extending around the bore 3, so that when a seal ring (not shown) is inserted and the connector 5 is tightened against the tubing head connection 6, a fluid tight seal is obtained.

A valve housing section 10 extends up from and is integral with the bottom connector 4. The section 10 forms a body cavity or opening 11 for receiving a conventional gate valve 12. The opening 11 communicates with the bore 3. The gate valve 12 is operative to open or close the bore 3, as required. Its hand wheel and bonnet assembly 13 protrude externally of the body 2.

A first B.O.P. housing section 15 extends up from and is integral with the valve housing section 10. The B.O.P. housing section 15 forms diametrically aligned or opposed side openings 16 communicating with the bore 3. The side openings 16 are formed to receive the ram assembly components 17 of a conventional hydraulically actuated B.O.P. 18. The operator 19 of the B.O.P. 18 protrudes externally of the body 2.

The valve housing opening 11 and B.O.P. openings 16 are offset or staggered so that the hand wheel and bonnet assembly 13 and B.O.P. operator 19 do not interfere.

A second B.O.P. housing section 20 extends up from and is integral with the first B.O.P. housing section 15. The housing section 20 forms diametrically opposed side openings 21 communicating with the bore 3. The side openings 21 are formed to receive the ram assembly components 22 of a conventional mechanically actuated B.O.P. 23.

The second B.O.P. openings 21 are offset relative to the first B.O.P. openings 16.

A flow tee housing section 25 extends up from and is integral with the second B.O.P. housing section 20. The flow tee housing section 25 forms opposed side openings 26 communicating with the bore 3. Each of the side openings 26 are shown having a studded connector 27 for connection with a flow line (not shown), through which well fluid is produced.

An internally threaded, studded top connector 28 extends up from and is integral with the flow tee housing section 25, for connection with the stuffing box.

From the foregoing it will be seen that by integrating functional components into a one-piece body and off-setting the body cavities, we have been able to incorporate a shut-off valve in combination with two B.O.P.'s into the pumping tree without exceeding an acceptable wellhead height.

In another feature, an integral bleeder valve system is provided in the body side wall to test whether the bottom B.O.P. 18 is leaking and to return leaking fluid to the bore 3. More particularly, a passageway 30 extends from the bore 3 from a point between the B.O.P.'s 18, 23 and connects back with the bore above the second B.O.P. 23. A port 31 leads from the passageway 30 to the outer surface 32 of the body 2. A pressure gauge (not shown) can be attached at the port 31 to monitor pressure in the passageway 30. A second port 33 connects with the passageway 30 from the body surface 32 and a needle valve 34 is positioned therein to open or close the passageway.

As previously mentioned, any of a variety of known connections can be substituted for the studded connections shown in the drawings.

The embodiments of the invention in which an exclusive property or privilege is claimed are defined as follows:

1. A pumping tree for use in a production wellhead assembly, comprising, in sequence from the bottom to the top:

a body formed as a single piece of steel and forming a vertical bore extending axially therethrough, said body comprising:

a bottom connector for connecting with the top connection of a tubing head a valve housing section forming a side opening, communicating with the bore, for receiving a valve for controlling fluid flow through the bore;

a first blow-out preventer housing section forming opposed side openings, communicating with the bore, for receiving ram assemblies of a blow-out preventer;

a flow tee housing section forming at least one side opening, communicating with the bore, for producing well fluid, and a top connector for connecting to an upper segment of a christmas tree.

2. The pumping tree as set forth in claim 1 wherein:

at least two of the valve housing section opening, blow-out preventer housing section openings and flow tee opening are staggered around the periphery of the housing.

3. The pumping tree as set forth in claim 2 wherein:

the body is generally cylindrical in configuration and thick-walled to provide a wall thickness/bore diameter ratio in the range of 1 to 1.

4. The pumping tree as set forth in claim 3 comprising:

a shut-off valve positioned in the opening of the valve housing section;

blow-out preventer components operatively positioned in the openings of the first blow-out preventer housing section; and means for securing a flow line to the flow tee housing section at the section's opening for removing produced well fluid.

5. The pumping tree as set forth in claim 2 wherein the body comprises:

a second blow-out preventer housing section positioned between the first blow-out preventer housing section and the flow tee housing section, said second blow-out preventer housing section forming opposed side openings, communicating with the bore, for receiving the ram assemblies of a blow-out preventer.

6. The pumping tree as set forth in claim 5 comprising:

a shut-off valve positioned in the opening of the valve housing section;

hydraulically operated blow-out preventer components operatively positioned in the openings of the first blow-out preventer housing section;

mechanically operated blow-out preventer components operatively positioned in the openings of the second blow-out preventer housing section; and means for securing a flow line to the flow tee housing section at its opening for removing produced well fluid.

7. The pumping tree as set forth in claim 6 wherein:

the body is generally cylindrical in configuration and thick-walled to provide a wall thickness/bore diameter ratio in the range of 1 to 1.

* * * * *

UNITED STATES PATENT AND TRADEMARK OFFICE

CERTIFICATE OF CORRECTION

PATENT NO. : 6,176,466 B1
DATED : January 23, 2001
INVENTOR(S) : Lam, Tony M.

It is certified that error appears in the above-identified patent and that said Letters Patent is hereby corrected as shown below:

Item (73)
Assignee: Stream-Flo Industries, Ltd., Edmonton (CA)

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*